United States Patent [19]

Tanaka et al.

[11] 4,163,141

[45] Jul. 31, 1979

[54] MICROWAVE OVEN

[75] Inventors: Junzo Tanaka, Fujidera; Toshio Kai, Yamatokoriyama, both of Japan

[73] Assignee: Matsushita Electric Industrial Co., Ltd., Osaka, Japan

[21] Appl. No.: 787,460

[22] Filed: Apr. 14, 1977

[30] Foreign Application Priority Data

Apr. 14, 1976 [JP] Japan ..... 51-42844
Apr. 26, 1976 [JP] Japan ..... 51-47974

[51] Int. Cl.[2] ..... H05B 9/06
[52] U.S. Cl. ..... 219/10.55 F
[58] Field of Search ..... 219/10.55 E, 10.55 F, 219/10.55 B, 10.55 D; 310/103; 108/94

[56] References Cited

U.S. PATENT DOCUMENTS

| | | | |
|---|---|---|---|
| 2,520,602 | 8/1950 | Linder | 333/21 R |
| 2,589,719 | 3/1952 | McKinney | 108/94 |
| 2,827,537 | 3/1958 | Haagensen | 219/10.55 D |
| 2,888,542 | 5/1959 | Mork | 219/10.55 F |
| 3,113,228 | 12/1963 | Tolegian | 256/DIG. 46 |
| 3,373,259 | 3/1968 | Smith | 219/10.55 F |
| 3,402,277 | 9/1968 | Muller | 219/10.55 F |
| 3,480,753 | 11/1969 | Wilson et al. | 219/10.55 D |
| 3,500,082 | 3/1970 | Tolegian | 310/103 |
| 3,975,606 | 8/1976 | Tanaka et al. | 219/10.55 F |
| 4,092,512 | 5/1978 | Suzuki et al. | 219/10.55 F |
| 4,107,502 | 8/1978 | Tanaka et al. | 219/10.55 F |

FOREIGN PATENT DOCUMENTS

| | | | |
|---|---|---|---|
| 2363076 | 12/1973 | Fed. Rep. of Germany | 219/10.55 D |
| 2618603 | 11/1976 | Fed. Rep. of Germany | 219/10.55 F |
| 47-39248 | of 1972 | Japan | 219/10.55 F |
| 1407852 | 9/1975 | United Kingdom | 219/10.55 F |

OTHER PUBLICATIONS

Indiana General Engineering Data Form 382, Magnetic Drives", Mar. 1970.

*Primary Examiner*—C. L. Albritton
*Assistant Examiner*—Bernard Roskoski
*Attorney, Agent, or Firm*—Wenderoth, Lind & Ponack

[57] ABSTRACT

A microwave oven is equipped with a rotary table driven by magnetic coupling. The microwave oven has a heating chamber in which at least its bottom wall or base plate is made of a non-magnetic metallic material, while its other walls are formed of metallic material other than non-magnetic metallic material, for reduction of the cost of the microwave oven. The junctions between the wall of non-magnetic metallic material and the walls of metallic material other than non-magnetic metallic material are coated with coating film to improve corrosion resistance. Furthermore, the heating chamber together with the rotary table is so arranged as to facilitate insertion and withdrawal of a container of food material into and from the heating chamber to provide a microwave oven which is clean and convenient to use.

6 Claims, 5 Drawing Figures

MICROWAVE OVEN

BACKGROUND OF THE INVENTION

The present invention relates to a high frequency heating apparatus, and more particularly, to a microwave oven or electronic oven equipped with a rotary table or turntable for receiving thereon an object to be heated.

A microwave oven which is now widely used essentially includes an oven-defining structure preferably of double wall construction provided therein with a heating cavity or heating chamber having a hingedly supported door which is adapted to selectively open and close an access opening formed at one side of the oven defining structure, and a magnetron assembly for generating high frequency energy so as to heat an object or food material placed within the heating cavity based on the principle of dielectric heating. Some known microwave ovens are further provided with rotary tables or turntables within the heating chambers for rotation together with the objects or food material mounted thereon so that the degree of heating of such objects is made uniform by causing them to move within the heating chambers.

Conventionally, in a microwave oven equipped with a rotary table of the above described type, the rotational force of a motor employed as a driving source is mechanically transmitted via reduction gears to a rotary shaft which extends into the heating chamber through the bottom plate thereof and which is fitted, for example, into a corresponding opening formed in the rotary table, while a plurality of rollers are rotatably disposed between the lower surface of the rotary table and the bottom plate of the heating chamber for smooth rotation of the rotary table.

The conventional microwave ovens of the above described type, however, have various disadvantages in that;

(i) Since the rotary shaft extends into the heating chamber through the bottom plate thereof, excessive heat generation, electric wave leakage and the like tend to take place during operation of the microwave oven, at the area where the rotary shaft projects into the heating chamber, and for the prevention of such inconveniences, the construction of the microwave oven is undesirably complicated, with consequent high cost.

(ii) The projection of the rotary shaft into the heating cavity and the provision of the rollers undetachably disposed within the heating chamber for smooth rotation of the rotary table make it difficult to clean the interior of the heating cavity in an efficient manner.

(iii) Drops of oil, juice and the like produced by the food material during cooking in the heating chamber, or water used for cleaning the interior of the heating chamber tend to leak out of the heating chamber through the clearance between the rotary shaft and the bottom plate of the heating chamber and to pass toward the motor, reduction gears and the like, thus not only giving rise to various operational problems, but also emitting unpleasant odors over the course of time.

(iv) Since the rotary table is mechanically coupled to the rotary shaft, it is difficult to readily remove the rotary table when necessary.

(v) Although non-magnetic metallic material is most suitable for the walls of the heating chamber for various reasons, such non-magnetic metallic material is expensive, thus resulting in a high cost of the miccrowave oven. On the other hand, if less expensive magnetic metallic material is employed, corrosion of such material comes into question.

(vi) When a vessel or container of glass, ceramic material and the like, with food material placed therein, is mounted on the rotary table, such vessel of hard material tends to damage the walls of the heating chamber upon contact therebetween during rotation of the rotary table or during insertion and withdrawal of the vessel into and from the heating chamber.

SUMMARY OF THE INVENTION

Accordingly, an essential object of the present invention is to provide a microwave oven equipped with a rotary table in which a magnetic driving system is employed to eliminate the necessity of the rotary shaft extending into the heating chamber, thus making the use of the microwave oven more efficient, with the interior of the heating cavity being coated to impart a clean appearance and an economical and durable structure to the heating chamber.

Another important object of the present invention is to provide a microwave oven of the above described type in which non-magnetic metallic material having high magnetic permeability is employed for a particular wall of the heating chamber to allow magnetic flux to pass therethrough during the magnetic driving operation, while the other walls of the heating chamber are formed with less expensive metallic material other than the non-magnetic metallic material, to thus reduce the cost of the microwave oven.

A further object of the present invention is to provide a microwave oven of the above described type in which the interior of the heating chamber is coated to prevent corrosion, especially at junctions between the walls of non-magnetic metallic material and metallic material other than the non-magnetic metallic material, due to battery action or the like.

A still further object of the present invention is to provide a microwave oven of the above described type in which a vessel or container employed to be mounted on the rotary table for placing food material to be heated therein is prevented from coming into contact with or rubbing against the coated walls of the heating cavity to thus avoid damage to the coating and consequent corrosion of the walls.

Another object of the present invention is to provide a microwave oven of the above described type in which an upper surface of the rotary table is arrange to be higher than that of the heating chamber bottom wall or base plate for improved processability during manufacturing and efficient cleaning in use, with the simultaneous facilitation of the insertion and withdrawal of the object to be heated into and from the heating chamber.

In accomplishing these and other objects, according to one preferred embodiment of the present invention, a microwave oven, equipped with a rotary table which is driven through magnetic coupling, has a heating chamber in which at least a bottom wall or base plate thereof is a plate made of non-magnetic metallic material, while its other walls are formed by plates of metallic material other than the non-magnetic metallic material, to thus reduce the cost of the microwave oven. The junctions between the wall of the non-magnetic metallic material and the metallic walls of the material other than the non-magnetic metallic material are coated with coating film to improve corrosion resistance. Furthermore, the heating chamber together with the rotary table is so arranged as to facilitate the insertion and withdrawal of a vessel for the object to be heated into and from the heating chamber. Thus, there is provided at a low cost a microwave oven which is clean and convenient to use.

BRIEF DESCRIPTION OF THE DRAWINGS

These and other objects and features of the present invention will become apparent from the following description taken in conjunction with the preferred embodiment thereof with reference to the attached drawings in which.

Before the description of the present invention proceeds, it is to be noted that like parts are designated by like reference numerals throughout several views of the accompanying drawings.

DETAILED DESCRIPTION OF THE INVENTION

Figure 1:
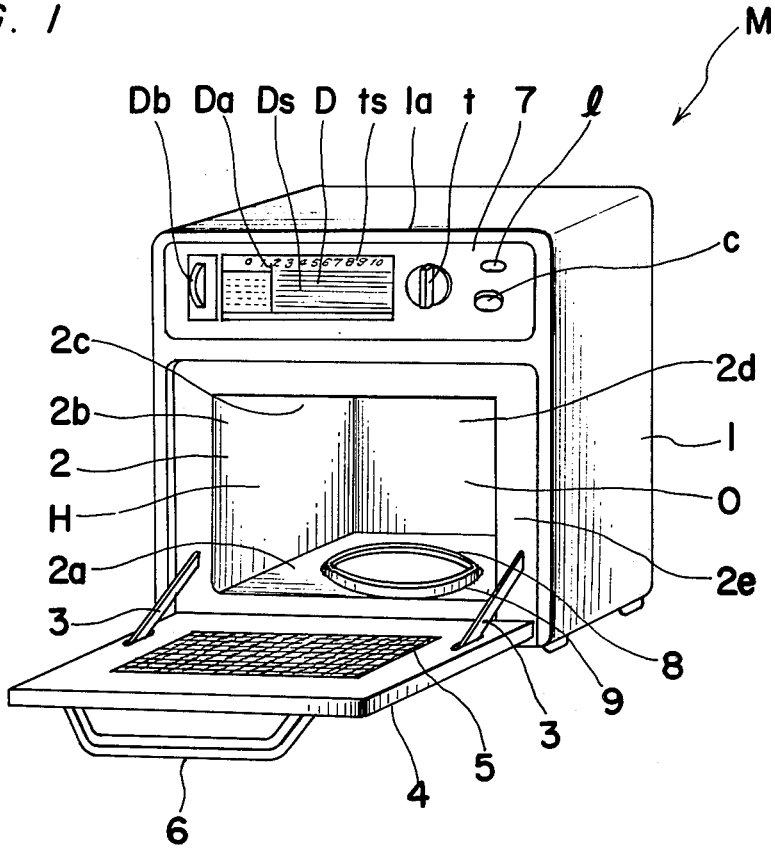
FIG. 1 is a perspective view of a microwave oven to which the present invention is applicable, with a door thereof in an opened state.
Figure 2:
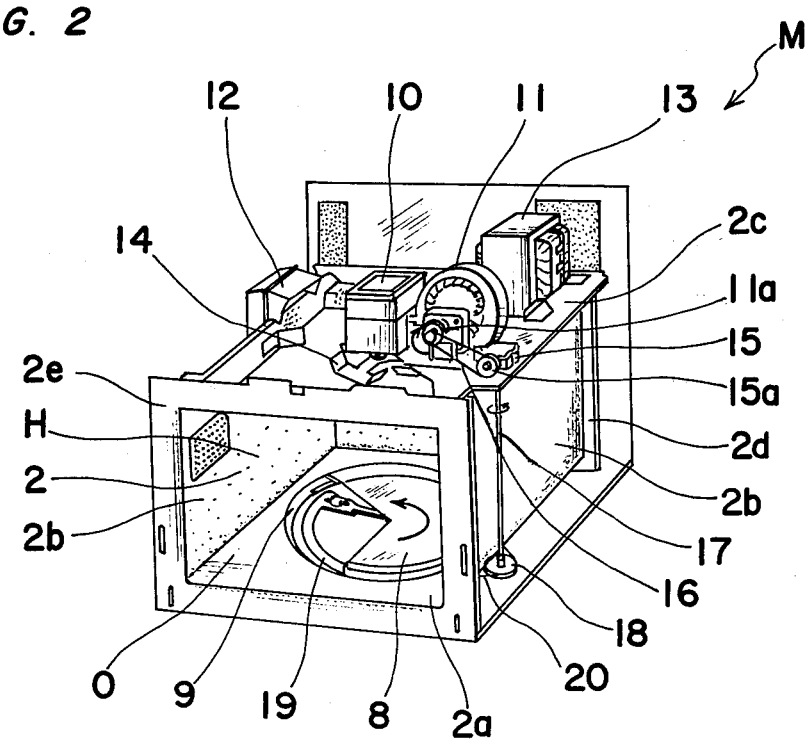
FIG. 2 is a view similar to FIG 1, but with the outer casing and the door removed for clarity.

Referring now to the drawings, there is shown in FIGS. 1 and 2 a microwave oven M to which the present invention is applicable. The microwave oven M heat-treats objects or food material based on the principle of dielectric heating by utilizing high frequency energy, for example, in the order of about 2450 MHz, and generally includes an outer casing 1 of cubical box-like shape open at the front side thereof. The outer casing 1 forms a double wall structure together with inner walls 2 which define a heating cavity or heating chamber H. The inner walls 2 include a horizontal bottom wall or base plate 2*a*, vertical side walls 2*b*, a top wall 2*c*, a rear wall 2*d* and also a front wall 2*e* which defines an access opening O at the front of the oven M. In the heating chamber H immediately above the horizontal base plate 2*a*, there is rotatably disposed a rotary table 8 in a manner as described below, on which 8 a vessel or dish (not shown) for accommodating an object or food material (not shown) to be heated therein detachably mounted. Outer surfaces of the walls 2*a*, 2*b*, 2*c* and 2*d* are spaced from the corresponding walls of the outer casing 1 for providing spaces therebetween. The outer casing 1 further includes an outside front wall portion 1*a* immediately above the opening O. On the front wall portion 1*a*, there is mounted a control panel 7 for controlling the functioning of a high frequency oscillator and the like mentioned below. The control panel 7 carries thereon a rotatable drum D having a scale Ds of heating time for a plurality of menus imprinted on its peripheral surface in positions corresponding to a timer scale $t_s$, a pointer needle Da for the drum D, a drum rotating ring Db, a timer operating knob t, a function indication lamp l to be illuminated during emission of high frequency energy and a cooking start button c for initiating the high frequency heating. For setting the heating time for optimum cooking, the drum D is rotated by the ring Db to find the heating time required for a particular food material to be cooked to which the pointed needle Da is aligned by the timer operating knob t.

Further included in the microwave oven M is a door 4 provided with a handle 6 adjacent to one edge thereof remote from a hinge through which the door 4 is supported, at the lower edge thereof to the lower front edge of the casing 1 in a position corresponding to the access opening O for pivotal upward and downward movements about the hinge so as to selectively open and close the opening O. The door 4 has a rectangular observation window 5 formed therein to allow the object placed in the heating cavity H to be observed therethrough and also for preventing the high frequency energy from leaking out of the heating chamber H during operation of the microwave oven M. The outer casing 1 further includes an interior portion which provides sliding accommodation for a pair of door arms 3, each of which is pivotally connected to a lower side portion of the door 4 and passes through a portion between the side walls of the casing 1 and the corresponding side walls 2*b* of the heating cavity H.

Referring particularly to FIG. 2, on the top wall 2*c* of the heating chamber H in the space defined between top wall 2*c* and the corresponding top wall of the outer casing 1, there are mounted the high frequency oscillator or magnetron assembly 10 for radiating high frequency energy into the heating chamber H, a fan motor 11 for cooling the magnetron assembly 10, an air guide 12 for leading the air after cooling the magnetron assembly 10 into the heating chamber H, a high voltage transformer 13 for supplying high voltage to the magnetron assembly 10, and worm gears 15 for transmitting the rotation of the fan mmotor 11 toward the rotary table 8 in a manner described in detail below, while a stirrer fan 14 is disposed to protrude into the upper portion of the heating chamber H for stirring the high frequency energy therein.

Figure 3:
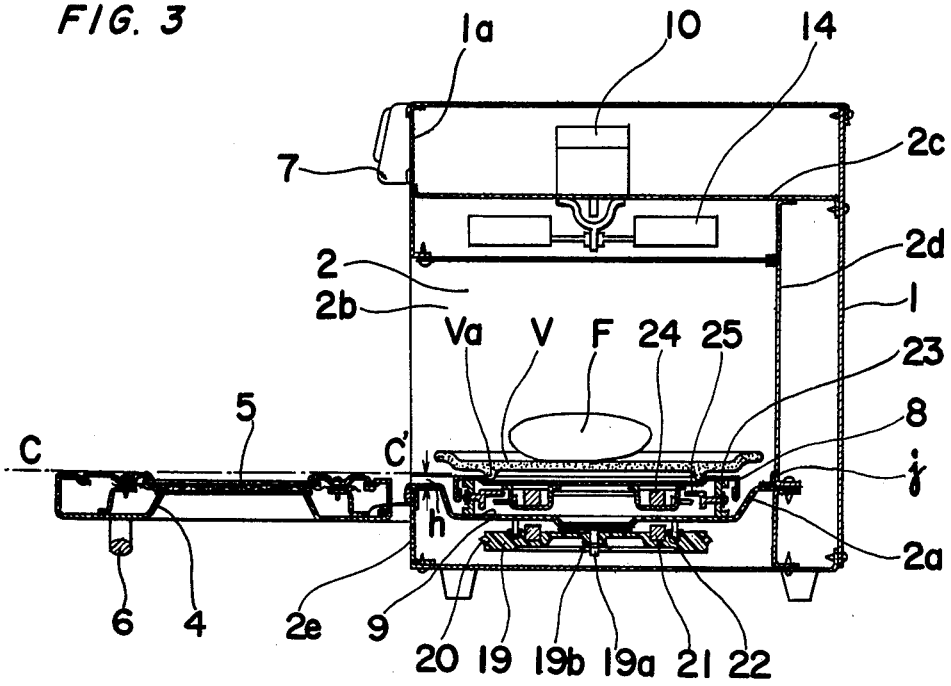
FIG. 3 is a schematic sectional view of the microwave oven of FIG. 1.

Referring also to FIG. 3, the mechanism for driving the rotary table 8 in the heating chamber H will be described hereinbelow.

A first pulley 11*a* secured to a rotating shaft of the fan motor 11 is connected to a second pulley 15*a* fixed to a worm shaft of the worm gears 15 through a belt 16, while a wheel shaft of the worm gears 15 extends downwardly to a bearing (not shown) secured to the bottom wall of the outer casing 1 to form a conducting rod 17, with a third pulley 18 being secured adjacent to the lower end of the rod 17. The pulley 18 is connected through a belt 20 to a pulley 19 which is rotatably disposed at approximately the same height as the pulley 18 under the lower surface of a circular recess 9 formed in generally the central portion of the base plate 2*a* of the heating chamber H for accommodating therein the rotary table 8. The pulley 19 is inserted over a shaft 19*a* secured, at one end thereof, to approximately the central portion of the lower surface of the recess 9, for example, by welding and pulley 19 is supported thereat by a pin 19*b* as shown. On the surface of the pulley 19 confronting the recess 9, there are disposed a plurality of magnets 21, and rollers 22, for example, of synthetic resinous material which rotatingly contact the lower surface of the circular recess 9, while the rotary table 8 rotatably supported within the recess 9 through rollers 23, for example, of similar synthetic resinous material is also provided with a plurality of magnets 24 which are fixed to the lower surface of table 8 at positions corresponding to the positions of magnets 21 of the pulley 19.

Accordingly, upon rotation of the pulley 19, the magnets 24 of the rotary table 8 are attracted by the magnets 21 of the pully 19, with consequent rotation of the rotary table 8. More than three rollers 23 for the rotary table 8 are provided and are held in place for example, by a coupling ring 25 for relative positioning thereat. The vessel or container V in which the object or food material F is to be placed is detachably mounted on the rotary table 8 for insertion into or withdrawal from the heating chamber H depending on necessity.

Figure 4:
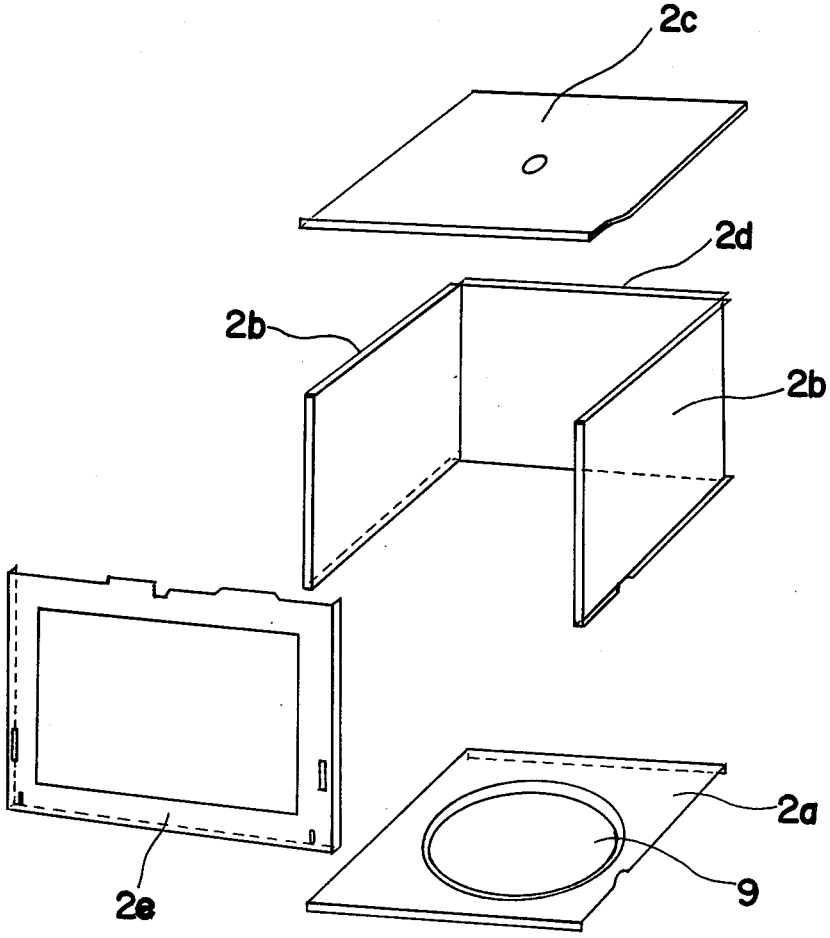
FIG. 4 is an expoded view showing the construction of the heating chamber employed in the microwave oven of FIG. 1.

Referring also to FIG. 4, in the walls 2 of the heating chamber H including the front wall **2*e* defining the access opening O, the side walls 2*b* and rear wall 2*d* which are preferably integrally formed into a single wall of approximately U-shaped cross section, the base plate 2*a* having the circular recess 9 formed therein, and the top wall 2*c*, the main portions of the front wall 2*e*, side walls 2*b*, rear wall 2*d* and top wall 2*c* are made of metallic material other than non-magnetic metallic material, while the base plate 2*a*** is constituted by non-magnetic metallic material having superior permeability for magnetic flux, for example, aluminum, aluminum alloy, stainless steel of the austenite group and the like.

In general, although the non-magnetic metallic material having large elongation characteristics may be readily subjected to a drawing process during manufacture with sufficient strength available, and is suitable for magnetic driving of the rotary table 8 due to its superior permeability for magnetic flux, such material is very expensive, thereby resulting in an extremely high cost of the microwave oven if the heating chamber H is constructed entirely of non-magnetic metallic material. Accordingly, in the microwave oven M according to the present invention, use of non-magnetic metallic material is limited to only the portion directly utilized for the magnetic driving operation, while other portions of the heating chamber H are made of metallic material other than non-magnetic metallic material, thus achieving a marked reduction of manufacturing cost without sacrificing the performance of the microwave oven.

Furthermore, after the walls **2*a* to 2*e* have been assembled, for example, by welding to form the heating chamber H, at least junctions j (FIG. 3) between the walls of the non-magnetic metallic material and the metallic material other than the non-magnetic metallic material are covered with a suitable coating film, for example, of synthetic resinous material for protection against open air, or water, juice and the like from the food material, so that such junctions are free from wet corrosion. Thus, the heating chamber has a high degree of durability. The formation of the coating film at the junctions j is also advantageous to avoid the accumulation of crumbs or chips of food material thereat for providing a clean heating chamber free from unsanitary appearance to the users. Additionally, a sufficiently durable coating film may further be formed, for example, through masking at a portion on the upper surface of the circular recess 9 where the rollers 23 of synthetic resinous material supporting the rotary table 8 contact, since the coating film tends to be readily soiled by pigments or the like from crumbs or chips of food material depressed by the rollers 23 to which all of the weight of the rotary table 8, the vessel V and the food material F are applied, or since the coating film may be peeled off in the worst case. By the above arrangement, not only is the coating film kept clean for a long period of time, but the rotational torque required for rotation of the rollers 23** can be reduced, because the frictional resistance upon contact between synthetic resinous materials is generally less than in the case where metallic material contacts synthetic resinous material.

In the microwave oven according to the present invention, the vessel V for accommodating the food material F to be heated therein is made of glass or ceramic material, to allow the food material F to be heated from its reverse surface by the high frequency energy, and also to prevent damage to the vessel V even when the food material F is scorched or burnt. Therefore, if coating or painting is applied onto the surface of the rotary table 8, such coating may readily be spoiled to give rise to corrosion when the vessel V is repeatedly placed on or detached from the surface of the rotary table 8. Accordingly, corrosion resistant metallic plate, for example, of stainless steel or synthetic resin such as polyester is employed for the rotary table 8, and thus a microwave oven having a clean appearance free from corrosion and having improved durability is obtained. Moreover, since the surface of the rotary table 8 is arranged to be higher than the surface of the base plate **2*a* by a distance h (FIG. 3), the diameter of the rollers 23 can be increased to reduce the frictional resistance during rotation of the rollers 23 and also to make it easy for the rollers 23 to roll over obstacles such as crumbs or chips of food material which may be present in the path of rotation of the rollers 23. The arrangement as described above is also effective for reducing the depth of the circular recess 9 which tends to be large in the conventional microwave ovens wherein the distance h is zero and less, and consequently for facilitating the drawing process in the manufacture of the microwave ovens, with the simultaneous elimination of the development of cracks at the corner portions during such process and the resultant improvement of yield. Also the mounting and detachment of the rotary table 8 in the heating chamber H are facilitated, with improved accessibility to the recess 9 for cleaning. Furthermore, according to the arrangement of the microwave oven of the invention as described above, the bottom rim Va of the vessel V is advantageously prevented from rubbing against the surface of the base plate 2*a* during insertion and withdrawal of the vessel V into and from the heating chamber H, so that even when such surface of the base plate 2*a* is coated, such coating is not likely to be worn or rubbed off, thus providing the heating chamber with improved durability. Additionally, when the microwave oven is provided with the door 4 which can be opened toward the user as shown in FIG. 3, the height of the inner surface c–c′ of the door 4 when fully opened is arranged to be approximately the same as that of the upper surface of the rotary table 8**, and therefore, the vessel V can be held horizontal at all times during insertion or withdrawal of such vessels, thus preventing any food material from spilling therefrom, thus making the microwave oven M very convenient to use.

Figure 5:
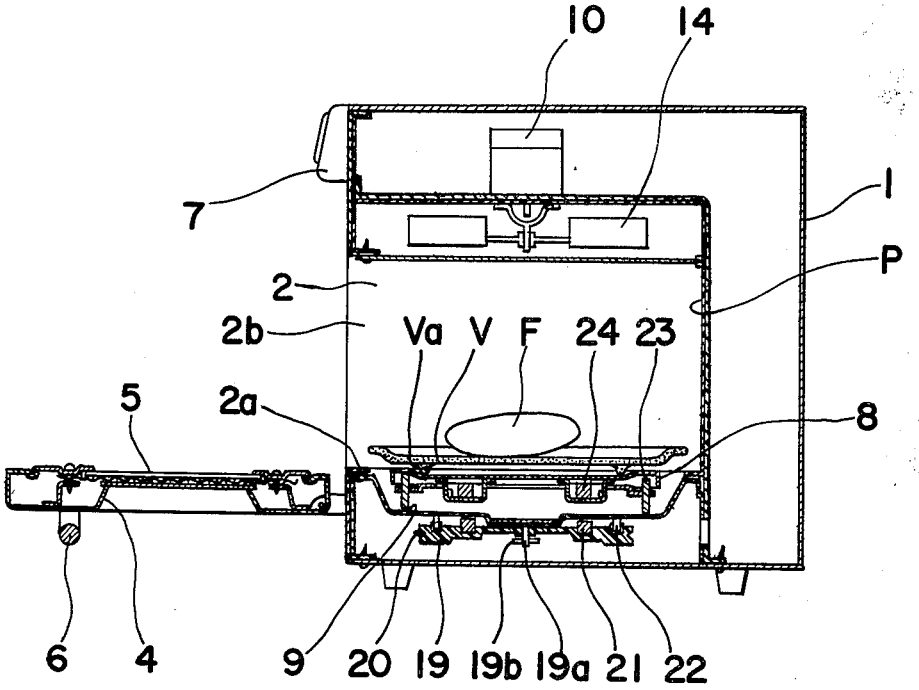
FIG. 5 is a view similar to FIG. 3, but particularly shows a modification thereof.

Referring to FIG. 5, there is shown a modification of the microwave oven of FIGS. 1 to 4. In this modification, the inner surface of the walls **2*b*, 2*c*, 2*d* and 2*e* of the heating chamber H are coated with coating film P except for the inner surface of the circular recess 9 of the base plate 2*a*, by which arrangement, the corrosion resistance of the heating chamber H is further increased, with improved appearance for cleanliness. Since other functions and constructions of the microwave oven of FIG. 5 are similar to those of FIGS. 1 to 4**, detailed description thereof is omitted for the sake of brevity.

It is to be noted here that in the foregoing embodiments, although the present invention is mainly described with reference to a microwave oven equipped with a rotary table, the concept of the present invention is not limited to such microwave ovens alone, but may readily be applicable to any other heating apparatuses without rotary tables which utilize high frequency energy for dielectric heating.

Although the present invention has been fully described by way of example with reference to the attached drawings, it is to be noted that various changes and modifications will be apparent to those skilled in the art. For example, the rear wall *2d* described as integrally formed with the side walls *2b* to form a single wall of U-shaped cross section in the foregoing embodiment may be modified to be separately formed for rigid connection with side walls *2b*. Therefore, unless otherwise such changes and modifications depart from the scope of the present invention, they should be construed as included therein.

What is claimed is:

1. A microwave oven comprising:

an oven defining structure;

a heating cavity within said oven defining structure, said heating cavity being defined by a base plate formed of a non-magnetic metallic material and by a top wall, a front wall having an access opening therein, a pair of side walls, and a rear wall, said walls being formed of magnetic metallic material, said base plate being joined at junctions to said front wall, said side walls and said rear wall;

door means for selectively opening and closing said access opening in said front wall;

means for supplying microwave energy into said heating cavity;

rotary table means, selectively and readily removably positioned to rotate in contact with a top surface of said base plate within said heating cavity, for receiving an object to be heated, said rotary table means being free of any fixed attachment to said base plate;

magnetic means, mounted below said base plate and exterior of said heating cavity, for rotating said rotary table means within said heating cavity; and coating means, covering said junctions and said top surface of said base plate, except the orbital area thereof to be contacted by said rotary table means, for preventing corrosion of said heating cavity.

2. A microwave oven as claimed in claim 1, wherein said base plate has therein a substantially circular recess, said rotary table means being rotatably mounted within said recess.

3. A microwave oven as claimed in claim 2, wherein the upper surface of said rotary table means is located at a level higher than the level of the uppermost portion of said base plate.

4. A microwave oven as claimed in claim 3, wherein said door means is hingedly supported for pivotal rotation at one edge thereof to said oven defining structure, so that when said door means is in a position opening said access opening, an upper surface of said door means extends substantially horizontally at a position approximately level with said upper surface of said rotary table means.

5. A microwave oven as claimed in claim 1, wherein said rotary table means comprises a rotary table member supported on said base plate solely by a plurality of roller members positioned substantially peripherally of said table member, said roller members being formed of a synthetic resin material.

6. A microwave oven as claimed in claim 5, wherein that portion of said base plate which is contacted by said roller members during rotation of said rotary table member is covered with a durable coating of synthetic resin material.

* * * * *